United States Patent [19]

Lombardozzi

[11] Patent Number: 4,810,553

[45] Date of Patent: Mar. 7, 1989

[54] THERMAL PANEL

[76] Inventor: Lucio Lombardozzi, 22-16 35th St., Astoria, N.Y. 11105

[21] Appl. No.: 932,281

[22] Filed: Nov. 19, 1986

Related U.S. Application Data

[63] Continuation-in-part of Ser. No. 810,362, Dec. 18, 1985, Pat. No. 4,636,444.

[51] Int. Cl.[4] ..... B32B 3/12

[52] U.S. Cl. ..... 428/116; 52/792; 428/156

[58] Field of Search ..... 52/792, 806; 428/116, 428/117, 118, 593, 156

[56] References Cited

U.S. PATENT DOCUMENTS

| | | | |
|---|---|---|---|
| 2,726,977 | 12/1955 | See et al. | 428/102 X |
| 4,203,268 | 5/1980 | Gladden, Jr. et al. | 52/630 |
| 4,276,873 | 7/1981 | Uroshevich | 52/630 X |
| 4,636,444 | 1/1987 | Lombardozzi | 428/156 X |

FOREIGN PATENT DOCUMENTS

| | | | |
|---|---|---|---|
| 751885 | 1/1967 | Canada | 428/116 |
| 0079492 | 5/1983 | European Pat. Off. | 52/145 |
| 227236 | 12/1975 | France | 428/178 |
| 1212052 | 11/1970 | United Kingdom | 428/116 |

*Primary Examiner*—Henry F. Epstein

[57] ABSTRACT

An improved construction for thermal panels employing a relatively thin base lamina having a plurality of contiguous polygonal recesses on the exposed surfaces thereof, with each of said polygonal recesses having a base surface of thermally radiant reflective character and a relatively thick backing layer of low thermal conductivity insulating material disposed in interfacial engagement with the other surface thereof.

8 Claims, 5 Drawing Sheets

FIG. 10a
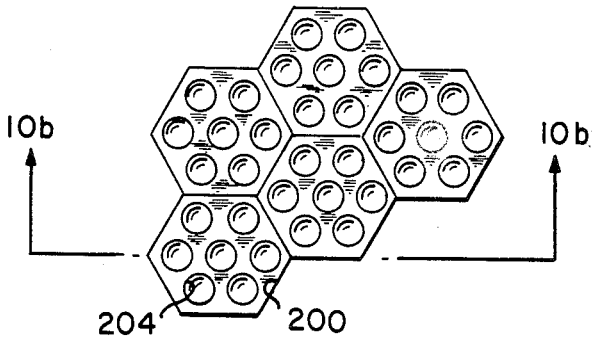
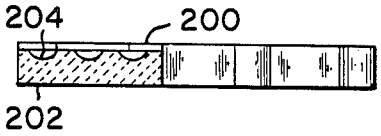
FIG. 10b
FIG. 10c
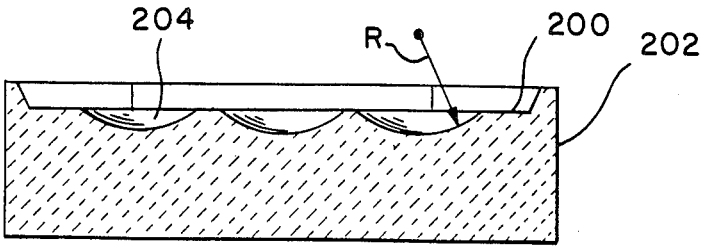

THERMAL PANEL

This application is a continuation in part of my application Ser. No. 810,362, filed Dec. 18, 1985 and now U.S. Pat. No. 4,636,444.

BACKGROUND OF THE INVENTION

This invention relates to thermal insulation and more particularly to an improved construction for thermal insulating panels.

The ever increasing demands for energy and the continually increasing costs of basic fuels have spurred interest not only in energy conservation in general, but, in the increased utilization of thermal insulation in particular. The general efficacy of thermal insulation has been long recognized and expedients ranging from the use of "dead air" space; the use of solid materials of low thermal conductivity; the use of fibrous and cellular materials; the use of coated papers or wallboards of low thermal conductivity; the use of reflective materials, such as aluminum foil, and various combinations and permutations thereof have long been employed for both industrial and residential purposes. In the practical utilization of most of such expedients, the degree of obtainable insulative effect, commonly expressed in terms of an "R" number—normally defined as the ratio of the material thickness divided by its thermal conductivity—is generally proportional to the thickness and/or quantity of insulating material employed. A particular area of concern is that of high temperature environments where, in addition to conventional insulating functions, it is oftentimes desirable to direct and/or delay heat transfer, to assure selectively directed heat transfer or confinement to a given zone or area such as in reaction vessels, piping and the like.

SUMMARY OF THE INVENTION

This invention may be briefly described, in its broader aspect, as an improved construction for a relatively thin and compact thermal panel module of increased insulative character and whose insulative performance is largely dependent upon its geometric character rather than on the inherent properities of its constituent materials. In furtherance of such broad aspect, the subject invention includes the utilization of a core lamina of relatively low thermal conductivity having a multiplicity of contiguous polygonal recesses on at least one of the exposed surfaces thereof and with each of such recesses having a concave base surface of thermally reflective character whose focal point is located outwardly from the exposed defining edges of such recesses. In a further broad aspect that is of general utility but which is Particularly directed for use in higher temperature environments, the subject invention includes the utilization of a relatively thin self-supporting core or base lamina having a multiplicity of contiguous polygonal recesses of the character described on the exposed surface thereof backed up by a relatively thick layer of lesser density insulating material to minimize conductive and/or convective heat transfer therethrough. In a narrower aspect, the exposed surface of the core or base lamina may be coated, in whole or in part, with a layer of material of high heat conductivity to accommodate lateral heat transfer thereon and the contiguous polygonal recesses may be of varying depth with a consequent location of the focal points thereof at differing levels above the panel surface. In a still narrower aspect the subject invention may include the formation of the relatively thin self suporting core or base lamina from castable ceramic material or from the flame spray plasma deposition of ceramic Powder on a suitable mold surface or by a combination of cast ceramic material having the exposed surface coated with a thin layer of highly reflective ceramic material deposited therein by flame spray plasma deposition processes.

Among the advantages of the subject invention is the provision of a self supporting thermal panel capable of utilization as a structural panel and which, in addition to its marked thermal insulative properties, also may serve as an acoustic barrier. Other advantages include the provision of a compact thermal panel possessed of marked insulative properties and whose radiant heat reflective properties become enhanced at extreme high temperatures. Still further advantages include the provision of a compact, inexpensive and easily fabricated thermal panel that provides enhanced insulative properties for energy efficient and economical industrial and home usage. Additional advantages include the accommodation of lateral heat transfer and the provision of shaped thermal panels in accord with the contours of the locus of use thereof.

The primary object of this invention is the provision of an improved construction for thermal insulative panels.

Another primary object of this invention is the provision of an improved construction for thermal insulative panels whose insulative performance is largely dependent upon its geometric character rather than on its size or the nature of its constituent materials.

Other objects and advantages of the subject invention will become apparent from the following portions of this specification and from the appended drawings which illustrate, in accord with the mandate of the patent statutes, a presently preferred embodiment of a thermal insulative panel construction that incorporates the principles of this invention.

BRIEF DESCRIPTION OF THE DRAWINGS

FIG. 10*a* is a schematic plan view of an alternative configuration for thermal panel;

FIG. 10*b* is a section as taken on the line 10*b*–10*b* on FIG. 10*a;*

FIG. 10*c* is an enlarged sectional view of a portion of FIG. 10*b*.

DETAILED DESCRIPTION OF THE INVENTION

Figure 1:
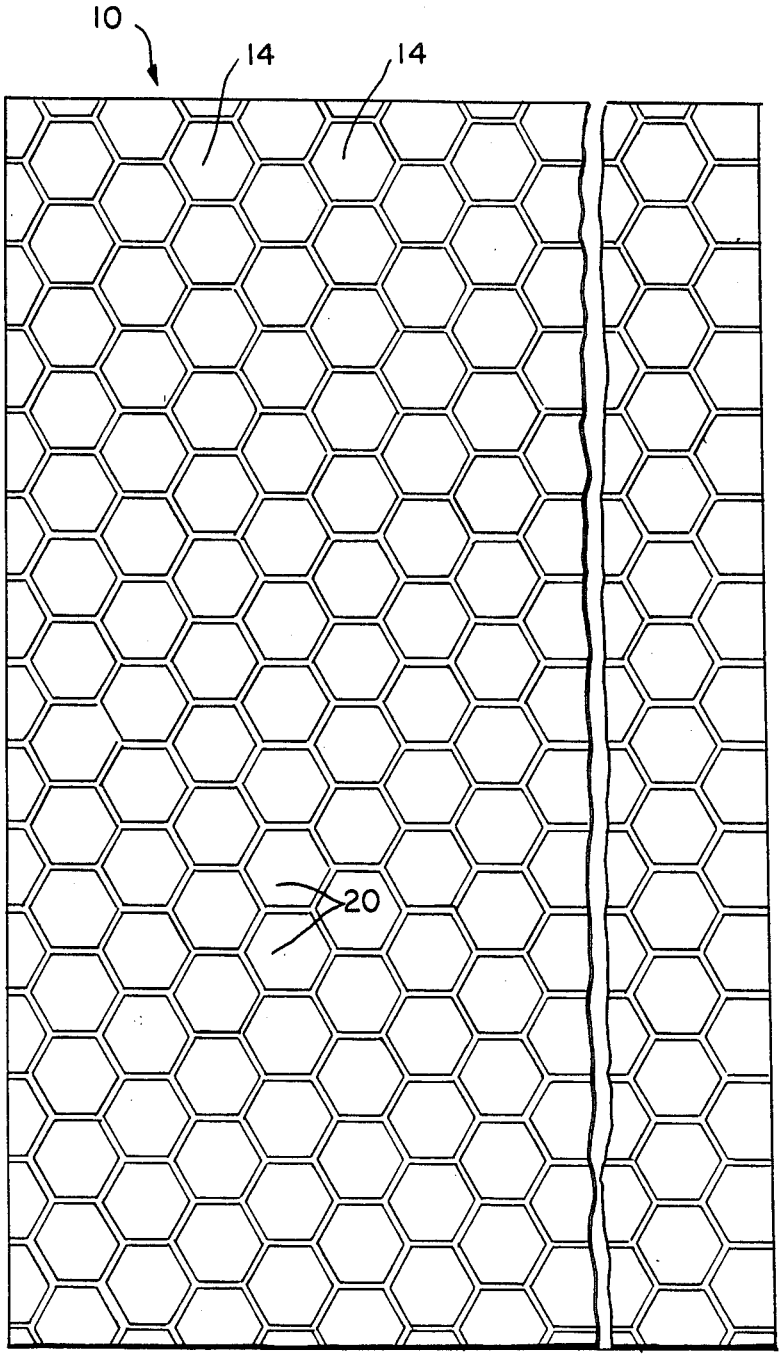
FIG. 1 is a plan view of a thermal panel module embodying the principles of this invention.
Figure 2:
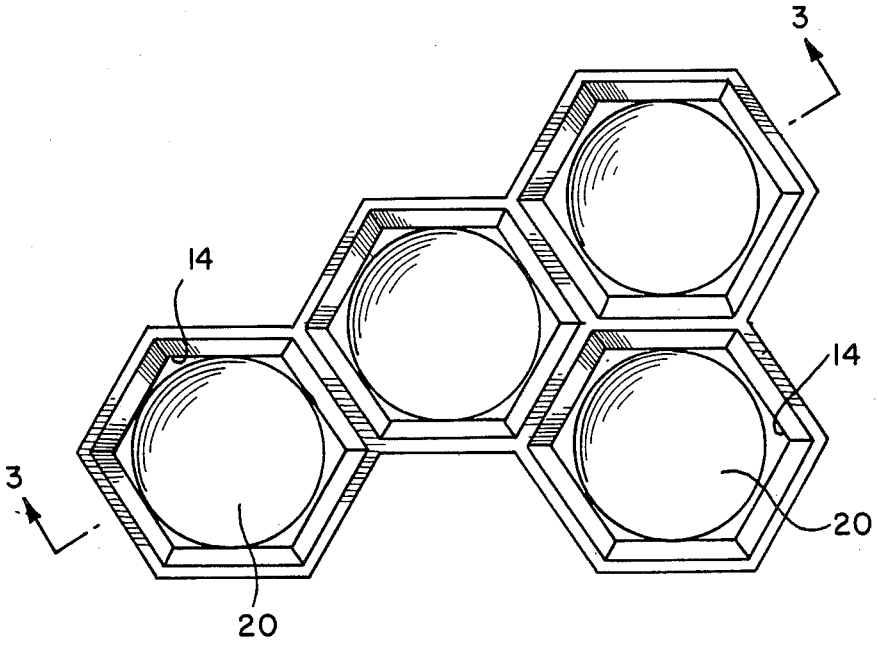
FIG. 2 is an enlarged plan view of a portion of the thermal panel illustrated in FIG. 1.
Figure 3:
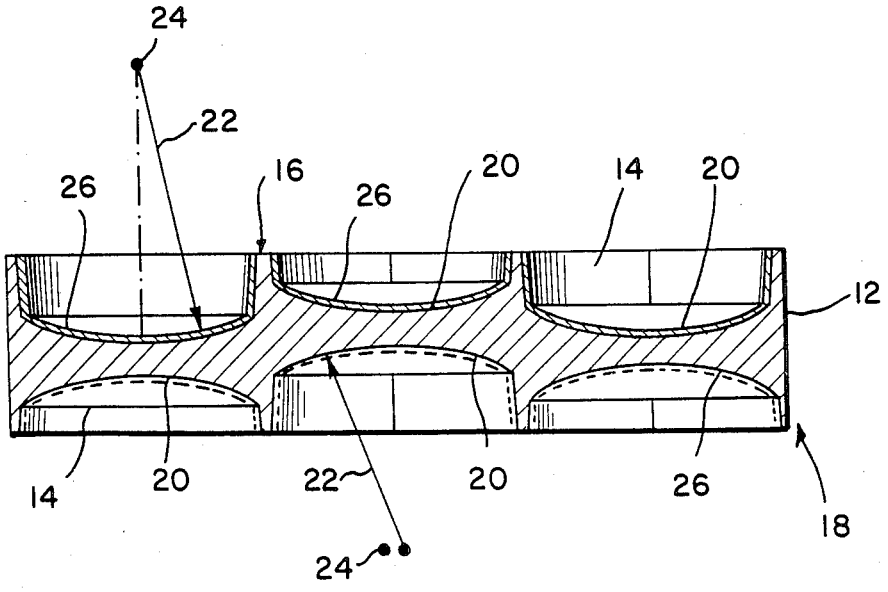
FIG. 3 is a vertical section as taken on line 3—3 of FIG. 2.

Referring to the drawings and initially to FIGS. 1–3, the improved thermal panel construction, as depicted by way of example in the form of a thin rectangular module 10 of generally planar character, includes a relatively thin core lamina 12 having a multiplicity of shallow contiguous polygonal recesses 14 on at least one, and preferably on both, of the exposed surfaces 16 and 18 thereof. The core lamina 12 is formed of material of low thermal conductivity and is preferably of rigid character so as to render the module 10 essentially self supporting. The polygonal recesses 14 should be of appropriate character to nest with each other and recesses of hexagonal configuration are highly preferred. As best shown in FIG. 3, the depth of such recesses 14 may vary in a predetermined regular pattern so as to lend the core lamina 12 certain truss characteristics for increased mechanical strength.

Each of the recesses 14 includes a concave base surface 20 of high thermally reflective character. The concave base surfaces 20 are suitably in the form of a segment of the surface of a sphere of a radius 22 that locates the focal point 24 a predetermined distance above the surface of the panel. As will now be apparent, the utilization of hexagonal shaped recesses 14 affords a maximum surface area for such concave base surfaces 20. As also best shown in FIG. 3, the desired high thermally reflective character for each of the concave base surfaces 20 may, for example, be obtained by the dispssition of an overlying thin film of reflective metal 26 on the surface of the core lamina 12.

As pointed out earlier, the insulative performance of the above described thermal panel results largely from its geometry rather than from its constituent materials, although certain properties of the latter, such as its melting or softening points, will usually be determinative of the ambient condition limits of its use. The utilization of a core lamina 12 of low thermal heat transfer characteristics and the minimization of effective contact area through the contiguous surface recesses cooperatively function to reduce, if not desirably minimize, heat transfer by conduction through the panel. Similarly, the concave base surfaces 20 of high thermally reflective character serve to reflect incident thermal radiation, which normally includes the infra-red spectrum and those portions of the light spectrum having wave lengths of about $10^{-2}$ to $10^{-5}$ centimeters. In such thermal reflection, the focal points of the concave base surfaces 20 will function as localized thermal sources at elevated temperatures in excess of ambient temperature. Such localized elevated termperature thermal sources will permit heat to flow therefrom to encourage radiant heat regeneration and to increase thermal radiation recovery.

As noted above, the constituent materials employed in the fabrication of the described panel, apart from the required low thermal conductivity for the core lamina material and the high thermal reflectivity properties for the concave base surfaces 20, are of concern mainly with respect to the ambient conditions at the locus of intended use thereof. For example, if the core lamina 12 is a moldable resin or polymer, the ambient temperature conditions at the point of usage must be below the softening point of such material. Where high temperature ceramic material is employed for such core lamina 12, the operating range will be permissibly higher. Likewise, in sch other instances where a high temperature core material, such as a high temperature ceramic, is employed, the limiting factor may be the melting point of the particular metal utilized to form a more highly efficient thermal radiation reflecting surface 26 on the concave base surface 20.

Figure 4A:
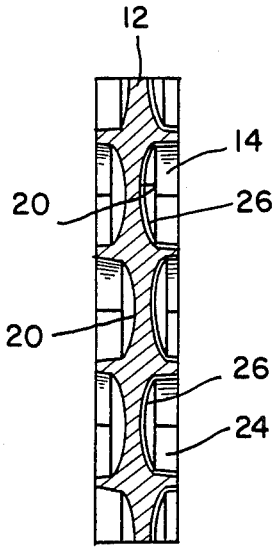
FIGS. 4*a* through 4*d* are schematic vertical sections illustrative of possible single or multipanel module combinations of the base panel construction.
Figure 4B:
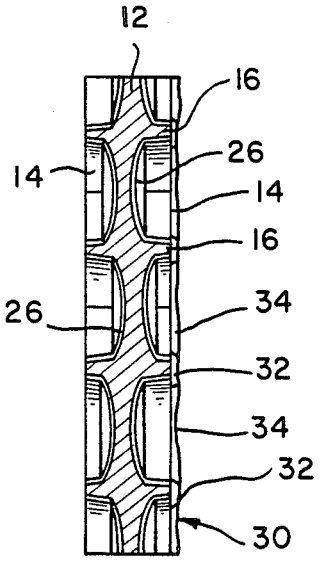
Figure 4C:
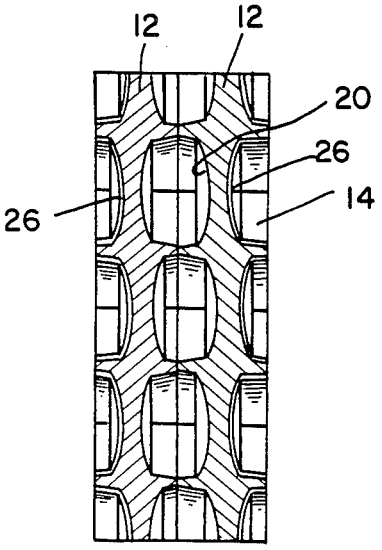
Figure 4D:
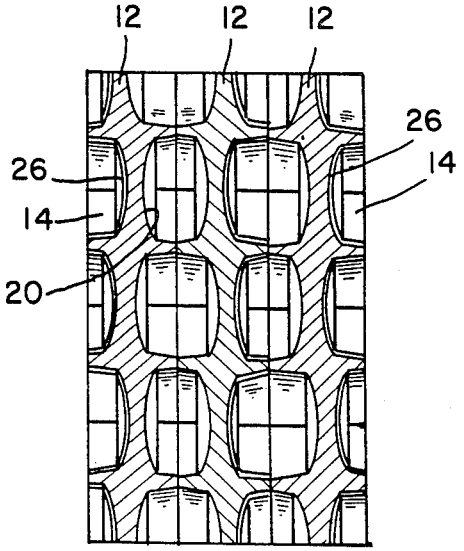

FIGS. 4*a* through 4*d* schematically illustrate how varying combinations of the improved thermal panel construction of both the single reflective coated face and double reflective coated face types can be assembled to form operative modules in accord with the exigencies of any particular locus of use thereof. FIG. 4*a* shows a single core lamina 12 having a reflective coating 26 on one of the exposed recessed surfaces 20 thereof. FIG. 4*b* shows a further configuration employing the Principles of this invention. As there shown, one surface 16 may be surmounted by a perforated plate 20 of highly heat conductive metal sheet. As shown, the solid portions 32 of such sheet overly the solid portions of the lamina and the apertures 34 therein are coaxially disposed with respect to the arcuate reflective surfaces located at the bottom of the recesses in the lamina. FIG. 4*b* further shows a single core lamina 12 having a reflective coating 26 on both exposed surfaces thereof. FIG. 4*c* shows a pair of single surface coated core lamina 12 that compositely present a double thickness core having both outwardly exposed surfaces bearing a thermally reflective coating 26. FIG. 4*d* shows three single surface coated cores in interfaced engagement with each other. As will now be apparent to those skilled in this art, many other combinative permutations are possible.

By way of further example, prototype thermal panels embodying the principles of the subject invention have been fabricated employing molded LEXAN resin as a core material. LEXAN is believed to be a thermoplastic polycarbonate condensation product of bisphenol and phosgen and is commercially available from General Electric Corp. of Pittsfield, Mass., as the core lamina 12. LEXAN has a thermal conductivity of about 1.35 (Btu-in/hr-ft-°F.) per ASTM C-177 and manufacturer's specifications. The reflective coating, which was applied to the entire exposed surfaces of the core lamina 12 as a matter of convenience, was vacuum metallized aluminum. Such unit was tested in accord with ASTM C-177 test method and produced the following results:

| | SAMPLE J - THICKNESS 0.402 | | | | | | |
|---|---|---|---|---|---|---|---|
| | 1 | 2 | 3 | 4 | 5* | 6* | 7* |
| Hot face temperature, F. | 32.6 | 96.54 | 183.58 | 213.88 | 349.31 | 403.20 | 264.22 |

-continued

| SAMPLE J - THICKNESS 0.402 | 1 | 2 | 3 | 4 | 5* | 6* | 7* |
|---|---|---|---|---|---|---|---|
| Cold face temperature, F. | 22.91 | 54.05 | 154.40 | 186.42 | 324.43 | 385.90 | 244.93 |
| Average sample temperature, F. | 27.76 | 75.29 | 168.99 | 200.15 | 336.87 | 394.60 | 254.58 |
| Thermal conductivity "k" Btu-in/hr-ft$^2$ - F | 0.492 | 0.513 | 0.582 | 0.607 | 0.916 | 1.45 | 1.32 |
| Total resistance, R, Hr-ft$^2$ - F/Btu | 0.82 | 0.78 | 0.69 | 0.67 | 0.44 | 0.28 | 0.31 |
| Total Conductance, C, Btu/hr-ft$^2$ - F | 1.22 | 1.28 | 1.45 | 1.49 | 2.27 | 3.57 | 3.23 |

*Changing with time (sample above softening point)

| SAMPLE F - THICKNESS 0.802 | 1 | 2 | 3 | 4 | 5 |
|---|---|---|---|---|---|
| Hot face temperature F. | 25.88 | 98.00 | 215.65 | 249.81 | 275.29 |
| Cold face temperature, F. | 19.42 | 51.00 | 176.12 | 212.12 | 239.30 |
| Average sample temperature, F. | 22.65 | 74.50 | 195.89 | 230.97 | 257.30 |
| Thermal conductivity, k, Btu-in/hr-ft$^2$ - F | 0.517 | 0.538 | 0.612 | 0.646 | 0.673 |
| Total resistance, R, Hr-ft$^2$ - F/Btu | 1.55 | 1.49 | 1.31 | 1.24 | 1.19 |
| Total conductance, C. Btu/hr-ft$^2$ - F | 0.65 | 0.67 | 0.76 | 0.81 | 0.84 |

Figure 5:
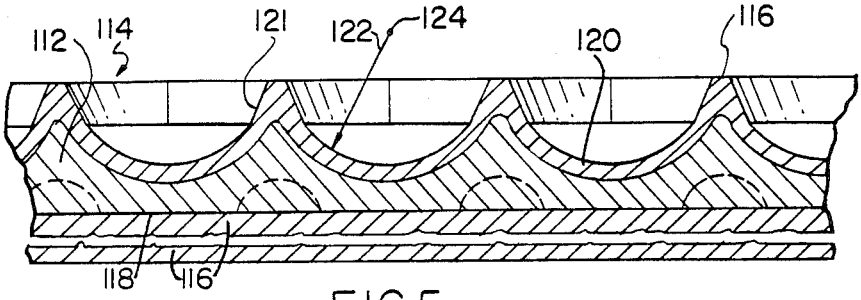
FIG. 5 is a vertical section taken through a presently preferred thermal panel construction adapted for use in high temperature environments.
Figure 6:
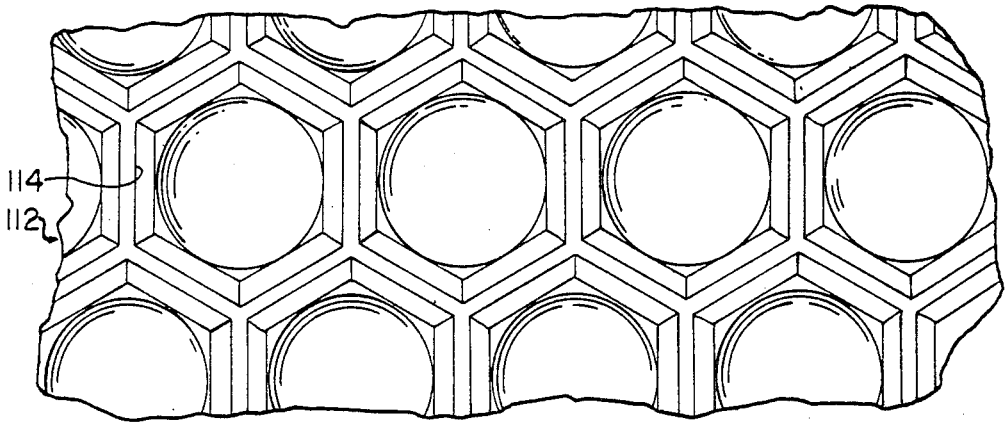
FIG. 6 is a plan view of the panel shown in FIG. 5.
Figure 7A:
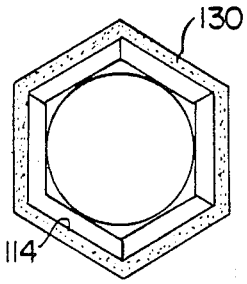
FIGS. 7*a* and 7*b* are schematic plan and sectional views respectively of an individual polygonal recess structure of the panel shown in FIGS. 5 and 6, having selective portions of the exposed surface coated with highly thermally conductive material.
Figure 8A:
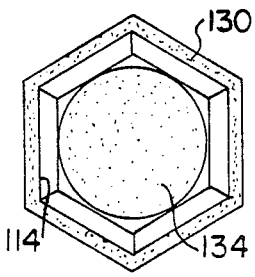
FIGS. 8*a* and 8*b* are schemitic plan and sectional views respectively of an individual Polygonal recess structure of the panel shown in FIGS. 5 and 6 having one portion of the surface thereof selectively coated with highly thermally conductive material and another portion thereof selectively coated with a high melting point material of high reflectivity.
Figure 9A:
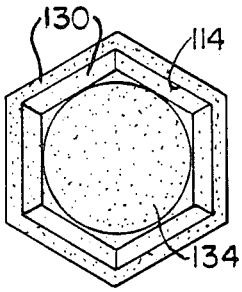
FIGS. 9*a* and 9*b* are schematic plan and sectional views respectively of an individual polygonal recess structure of the panel shown in FIGS. 5 and 6 having selective portions of the surface thereof coated with highly thermally conductive material and another potion thereof selectively coated with a high melting point material of high reflectivity.
Figure 7B:
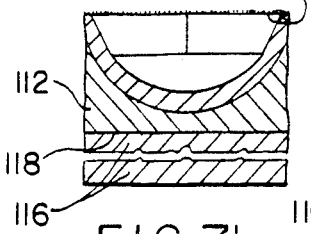
Figure 8B:
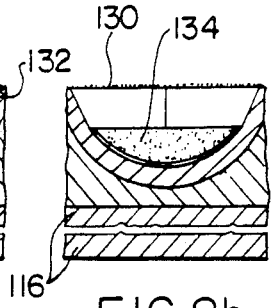
Figure 9B:
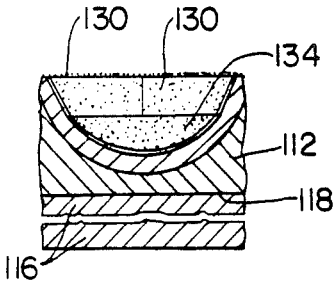

FIGS. 5 and 6 illustrate a presently preferred construction for thermal panels particularly adapted for use in higher temperature environments. There is here provided a relatively thin core or base lamina 112 having a multiplicity shallow contiguous polygonal recesses 114 on the upper exposed surface 116 thereof. The base lamina 112 is here formed of high melting point material and, in a preferred embodiment, is also desirably formed of material of low thermal conductivity. Suitable materials include ceramics such as aluminum oxide, fused silicon dioxide, aluminumo-silicates and like materials that can withstand ambient temperatures in the order of 1500° to 2000° F. and higher. The base lamina 112 is again preferably of rigid character to render it self-supporting, suitably about 0.010 to 0.050 inch thick or greater, and can be of a shape that is complemental to the surface contours or other characteristics of its locations of ultimate use. For example, the base lamina 112 can be of planar character for use as a wall or panel member, or can be of semicylindrical configuration if its locus of ultimate use is to enclose or encase a conduit, such as a steam pipe or the like.

The undersurface 118 may be appropriately contoured to provide a base lamina 112 of generally uniform thickness. Such base lamina 112 may be formed of castable ceramic materials such as various "Advanced Ceramic Castables" as manufactured by the Cotronics Corporation of Brooklyn, N.Y. Such base lamina may also be formed by the flame spray plasma deposition of ceramic powder having a high coherent and low adhesive strengths. Alternatively such lamina 112 may be formed of castable ceramic with its surface radiant heat reflectively enhanced by the flame spray plasma deposition of a thin ceramic layer of high reflectivity upon the exposed recess surface 114 thereof. Bonded or otherwise adherently disposed in interfacial relationship with the undersurface of the base lamina 112 is a relatively thick layer of appropriate insulating material 116 to minimize, if not eliminate, conductive heat transfer therethrough. Suitably, such material may comprise one or more inches of ceramic ooam material or one or more inches of fibrous or other type insulating materials of conventional character. As will be apparent to those skilled in this art, the character and thickness of such insulative backing material 116 will be basically dependent upon the ambient conditions that are extant at the locus of use.

As previously described, the polygonal recesses 114 should be of appropriate character to nest with each other and recesses of hexagonal configuration are highly preferred. Each of the recesses includes a sloped side wall configuration 121 of planar character and a base surface 120 of a high thermally reflective character, desirably of concave contours. Such concave base surfaces 120 are suitably in the form of a sphere of a radius 122 that locates the focal point 124 a predetermined distance above the surface of the panel.

FIGS. *7a, 7b; 8a, 8b;* and *9a, 9b* are illustrative of various surface finishes applicable to the polygonal recesses 114 to accommodate the complemental functions of transverse or lateral heat flow and enhanced radiant heat reflection. In FIGS. *7a* and *7b,* a coating of high thermal conductivity 130 is selectively located on the upper surfaces 132 of the defining walls of the polygonal recesses 114. Such coating 130 may suitably comprise a thin coating of silver or other metal of high thermal conductivity and will function to effect conductive heat transfer laterally along the surface of the pnael.

FIGS. *8a* and *8b* illustrate, in addition to the coating 130 of high thermal conductivity, the deposition of a coating 134 possessing highly reflective properties on the concave base surface 120 to enhance the degree of radiant heat reflection therefrom. Such coating 134 may be of the same or different material as that of the coating 130.

FIGS. *9a* and *9b* depict a composite structure wherein the coating 130 of high thermal conductivity is extended to cover the sloped side walls 121 of the polygonal recesses 114 and the concave base surfaces 120 have the coating 134 of high thermally reflective character thereon.

FIGS. 10*a* to 10*c* illustrate a further construction for a thermal panel. As here illustrated there is provided a hexagonal recess 200 in a ceramic base lamina 202. Each of such recesses includes a plurality of concave base surfaces 204 of high thermally reflective character that function to reflect incident thermal radiation. In such thermal reflection the focal points of the concave base surfaces will again cooperatively function as localized thermal sources at elevated temperatures in excess of ambient temperatures.

As Pointed out earlier, the subject panels have exhibited some degree of acoustic barrier properties as well as the above noted insulative characteristics.

Having thus described my invention, I claim:

1. An improved thermal panel construction comprising a relatively thin and substantially rigid base lamina formed of material having a high melting point and having a multiplicity of ever open contiguous polygonal recesses on an exposed surface thereof positionable in exposed facing relation to a source of radiant heat, each of said polygonal recesses having a concave base surface of a radiant heat reflective character positionable in exposed facing relation to said source of radiant heat and whose focal point is located above the upper marginal edges of said ever open polygonal recesses, and a relatively thick layer of low thermal conductivity insulating material disposed in interfacial engagement with the surface of said lamina disposed remote from said recess bearing surface thereof.

2. A thermal panel construction as set forth in claim 1 further including a coating of material of high thermal conductivity disposed in interfacial relation upon the recess defining surface portions of said exposed surface.

3. A thermal panel construction as set forth in claim 1 wherein said polygonal recesses are of closely nested hexagonal configuration.

4. A thermal panel construction as set forth in claim 1 wherein said concave base surfaces of said recesses are coated with a thin layer of a highly radiant reflective character.

5. A thermal panel construction as set forth in claim 1 wherein said relatively thick layer of insulating material is ceramic foam.

6. A thermal panel construction as set forth in claim 1 wherein said base lamina is formed of ceramic material.

7. A thermal panel as set forth in claim 6 wherein said relatively thick layer of insulating material is ceramic foam.

8. A thermal panel as set forth in claim 1 wherein each said polygonal recess includes a plurality of concave base surfaces of a radiant heat reflective character.

* * * * *